US007708145B2

(12) United States Patent
Li et al.

(10) Patent No.: US 7,708,145 B2
(45) Date of Patent: May 4, 2010

(54) DRY SEPARATING TABLE, A SEPARATOR AND EQUIPMENT FOR THE COMPOUND DRY SEPARATION WITH THIS TABLE

(75) Inventors: Gongmin Li, Tangshan (CN); Yunsong Yang, Tangshan (CN)

(73) Assignee: Tangshan Shenzhou Machinery Co., Ltd., Tangshan, Hebei Province (CN)

( * ) Notice: Subject to any disclaimer, the term of this patent is extended or adjusted under 35 U.S.C. 154(b) by 335 days.

(21) Appl. No.: 10/557,368

(22) PCT Filed: Sep. 12, 2003

(86) PCT No.: PCT/CN03/00768

§ 371 (c)(1),
(2), (4) Date: Nov. 18, 2005

(87) PCT Pub. No.: WO2004/101157

PCT Pub. Date: Nov. 25, 2004

(65) Prior Publication Data

US 2007/0023327 A1 Feb. 1, 2007

(30) Foreign Application Priority Data

May 18, 2003 (CN) ..... 03 2 61328

(51) Int. Cl.
*B07B 4/00* (2006.01)

(52) U.S. Cl. ..... 209/471; 209/472; 209/486; 209/492; 209/502; 209/504; 209/506

(58) Field of Classification Search ..... 209/471, 209/472, 486, 492, 502, 504, 506
See application file for complete search history.

(56) References Cited

U.S. PATENT DOCUMENTS 1,870,042 A * 8/1932 Dorfan ..... 209/502

(Continued)

FOREIGN PATENT DOCUMENTS

CN 2101532 11/1992

(Continued)

OTHER PUBLICATIONS

Yunsong Yang et al., "Research and application of technology for combined dry coal separation," *Coal Processing and Comprehensive Utilization*, 2002, pp. 2-7, ISSN 1005-8397.

(Continued)

*Primary Examiner*—Patrick H Mackey
*Assistant Examiner*—Kalyanavenkateshware Kumar
(74) *Attorney, Agent, or Firm*—James P. Muraff; Neal, Gerber & Eisenberg LLP

(57) ABSTRACT

The present invention discloses a combined dry sorting bed, the sorting bed is arranged with an inclination, and the inclination between the longitudinal extending of said bed surface and horizontal plane is from −2° to +4°, and the inclination between the lateral extending of said bed surface and horizontal plane is from 0° to +15°. By reasonable setting of the angle of inclination, the material being separated spiral overturn continuously on the sorting bed under the influence of the rising air currents and the force of vibration, with the result that the light material in the upper layer is separated under the influence of weight. The material is sorted for many times during the circularly movements, the product with different content of ash can be obtained. This invention also relates to a combined dry sorting device that comprises frame, sorting bed, vibrator and air supply device. This invention further relates to an apparatus for separation that comprises a feeding device, an air supply and dedusting device and a separating device, the above mentioned sorting bed is used in the sorting device and apparatus, therefore different products with vary quantity of ash are generated according to the gravity of material, and the accuracy of separation is improved.

13 Claims, 7 Drawing Sheets

U.S. PATENT DOCUMENTS

| | | | | | |
|---|---|---|---|---|---|
| 2,261,278 | A | * | 11/1941 | Peale et al. | 209/467 |
| 2,309,355 | A | | 1/1943 | Peale | |
| 2,512,422 | A | * | 6/1950 | Fletcher et al. | 209/475 |
| 3,291,301 | A | * | 12/1966 | Brastad | 209/12.2 |
| 3,406,824 | A | * | 10/1968 | Forsberg | 209/467 |
| 3,863,766 | A | * | 2/1975 | Oetiker | 209/469 |
| 3,888,352 | A | * | 6/1975 | Kulseth | 209/643 |
| 3,904,517 | A | * | 9/1975 | Wilson | 209/441 |
| 5,024,334 | A | * | 6/1991 | Misra et al. | 209/557 |
| 5,087,351 | A | * | 2/1992 | Valentine, Sr. | 209/20 |
| 5,183,161 | A | * | 2/1993 | Mueller | 209/467 |
| 5,375,720 | A | | 12/1994 | Piggott et al. | |
| 5,860,531 | A | * | 1/1999 | Satoru et al. | 209/37 |

FOREIGN PATENT DOCUMENTS

| | | |
|---|---|---|
| CN | 2314850 | 4/1999 |
| CN | 2467207 | 12/2001 |
| EP | 1125645 | 8/2001 |
| GB | 350497 | 6/1931 |
| JP | 11253885 | 9/1999 |
| JP | 2000061398 | 2/2000 |

OTHER PUBLICATIONS

Wenmin Wang et al., "Improvement in the system of combined dry coal separation," *Coal Processing and Comprehensive Utilization*, 2002, pp. 8-10, ISSN 1005-8397.

Translation of Chinese Patent Application CN2101532.

Translation of Chinese Patent Application CN2314850.

Translation of Chinese Patent Application CN2467207.

* cited by examiner

DRY SEPARATING TABLE, A SEPARATOR AND EQUIPMENT FOR THE COMPOUND DRY SEPARATION WITH THIS TABLE

CROSS-REFERENCE TO RELATED APPLICATIONS

This application is a U.S. national stage application under 35 U.S.C. §3.71 of international stage application PCT/CN2003/000768, filed Sep. 12, 2003, which claims priority of Chinese patent application serial number 03261328.8, filed May 18, 2003.

FIELD OF THE INVENTION

This invention relates to a dry sorting bed, a combined dry sorting device with the sorting bed and an apparatus for separation, which is a solid sorting apparatus and is particularly suitable to be used to the sorting of coal from waste-rock and pyrite, and the sorting of solid particle intermixture whose densities are different from each other.

BACKGROUND OF THE INVENTION

It is well known that the dry sorting apparatus used in industrial production at home and abroad are mainly pneumatic jig and air table. The method of using air to replace water as sorting medium has already been eliminated through selection gradually for its poor sorting effect, low production capacity and a large amount of wind power demand.

An adverse current sorting apparatus was disclosed by American Graham & Troman Co., Ltd in Volume one of the book *Coal-beneficiation Technique* published in 1988. It's a kind of air table, whose bed surface is rectangular and is provided with an inclination of 10°. The longitudinal vibration device makes the bed surface move longitudinally and the bed surface adopts a perforated plate. A blower fan sends wind under the plate at a constant wind speed and pressure. The upward flowing airflow makes the materials on the bed surface sorted in layers and then the heavier waste-rock falls onto the perforated plate through the table and move upward and slantways along the bed surface effected by eccentric to-and-fro movement. In this way, the lighter coal emerges at the upper layer on the table and is pushed by the fed-in materials to move along the downwards-slanting bed surface. In nature, it's a kind of air-fluidized bed. The sorting is completed on the bed surface at a time. The float coal is discharged at a time, but it is easy for fine grain waste-rocks to drop in the coal. Therefore, the sorting effect is very poor, the production rate is low and the demanded wind power is very large. There is also another kind of dry type shaking table, which needs no wind power and depends on the helical motion of the materials to make the materials sorted in layers. In this way, the coarse grains stay at the upper layer and the fine grains stay at the lower layer. So, the sorting effect is poor because it is made according to the density of the materials.

A combined type sorting method was published in 1990s, which adopts the self-born medium (i.e. the fine grain coal contained in the raw coal to be sorted) and air to form air-solid two-phase medium for sorting; which utilizes mechanical vibration to sort the materials time after time by making them roll spirally; and which makes the most of the buoyancy effect of the interaction between grains generated by the gradually increased density of the materials on the table to sort the materials. Under such a condition that the materials are made to roll spirally on the bed surface of the sorting apparatus, the combined action of the vibratory force and the ascending air is utilized to make the material layers on the table incompact and make the mineral grains layered according to density. Under the effect of gravity, the materials whose density on the surface layer is low are delaminated. While this action is repeated, the materials are sorted time after time. By delaminating layer upon layer, several kinds of products are produced whose ash contents are from low to high, until the waster rocks and iron pyrites are discharged. Then, sorting is made by making use of the fine grain materials in the fed-in raw coal (called self-born medium) and upward flowing gas to form air-solid two-phase medium. In this dispersion medium with a certain density, the low-density materials emerge upward and the high-density materials sink. Then, pure waste-rock product is obtained by making use of the buoyancy effect generated by the interaction of the heavier grains to make the coal grains mixed in the waste-rock layer emerge continuously.

CN2101532 and CN2314850 respectively disclosed the above combined type of dry sorting apparatus, which are applicable to sorting material of solid particle admixture, in which the density of the solid particles is different. The sorting apparatus consist of a vibrator and a sorting bed hung from the frame to form a vibration bed. The vibration bed is provided with lattice bars according with the direction of the motion of materials. The bed surface between lattice bars is equably provided with vertical wind ports connected with the air chambers. A slanting backboard is attached to the back of the sorting bed surface. Affected by the vibratory force and upward flowing gases, the materials move spirally and are sorted into layers according to density. Through circulatory sorting time after time, the low-density materials are separated from the high-density materials.

However, the following problems exist in the sorting beds disclosed by above two patents:

Firstly, the above patents didn't disclose the obliquity of the bed surface of which the lateral angle and longitudinal angle directly affect the sorting effect. If the lateral angle is too small, the thickness of the materials on the table will increase and the sorting speed of the coal on the surface will decrease. If the lateral angle is too large, the vibration speed of the high-density materials at the bottom will decrease, or may not move at all, which will ruin the sorting process. If the longitudinal positive angle (waste-rock discharging end is lower than material feeding end) is too large, the waste-rocks and coal will gather into the waste-rock discharging port. If the longitudinal negative angle (waste-rock discharging end is higher than material feeding end) is too large, the waste-rocks will move at an excessively low speed and accumulate too much on the table to ruin the sorting process. Therefore, it is extremely important for the bed surface have a rational obliquity. Secondly, the functions of the parallel lattice bars on the bed surface include: (i) guiding the high-density mineral grains to move to the waste-rock channel; (ii) increasing the speed of the high-density mineral grains at the bottom of materials on the bed surface to move to the waste-rock end, which is propitious to the increasing of the processing rate of the sorting bed; (iii) sorting function to a certain extent. The low-density coal at the top of the materials on the bed surface can cross over the lattice bars to move to the material discharging side and the high-density materials at the bottom of the materials on the bed surface will be the held up by the lattice bars and can only move along the lattice bars to the waste-rock end, which increases the sorting accuracy. Therefore, an appropriate height and obliquity of the lattice bars is very important to the effect of sorting. Thirdly, the shape of the bed surface is square pentagon and the proportion of the width of the feeding side to the length of the bed surface is 4:10, resulting in shorter sorting time, easier for waste-rocks to drop in the float coal and more difficult for sorting accuracy to be increased. Fourthly, the above patents didn't provide the degree of the obliquity between the backboard and the bed surface, but the angle of the backboard guides the materials to move spirally, which is very important for the separation of light materials. Fifthly, vibration form of the bed surface is electromagnetic vibration or low amplitude inertial force vibration, which isn't propitious to the sorting of the materials whose partial sizes are comparatively large and which moves the materials at the bottom of the materials on the bed surface at a low speed and it is very difficult to increase the production capacity.

OBJECT OF THE INVENTION

Therefore, the first object the present invention is to provide a combined dry sorting bed, of which the sorting accuracy is comparatively high and the production capacity is comparatively large, to overcome the shortcoming of the obliquity of the sorting bed surface of the prior art so that the sorting accuracy and efficiency accordingly can be increased.

The present invention further overcomes the irrationality of the lattice bars setting angle on the sorting bed surface of the prior art and select rational lattice bar obliquity to improve the sorting quantity.

This invention further overcomes such problems that the sorting bed is too narrow, the breadth length ratio is too small, the initial sorting time is too short and the sorting accuracy is low in the prior art.

The second object of the present invention is to provide combined dry sorting advice with the above sorting bed of this invention that can overcome the limitation of the prior art and is provided with a rational obliquity, aspect ratio, lattice bar obliquity and backboard obliquity to improve the sorting accuracy.

This invention is further provided with rational vibratory strength to improve sorting accuracy and production capacity.

The third object of present invention is to provide apparatus for separation that can integrate sorting with de-dusting, blowing and feeding, whose sorting bed overcomes the shortcomings of the sorting bed of the prior art.

SUMMARY OF THE INVENTION

To realize above object, the present invention firstly provided a combined dry sorting bed, comprising the bed surface that is approximately right-angled trapezoid, whose hypotenuse is the material discharging side of the sorting bed. A discharging baffle is provided in the material discharging side. A backboard that guides the materials to roll upwards is set at the right angle side opposite to the material discharging side. The wider side of the bed surface is the feeding side and the narrower side is waste-rock discharging end. A plurality of air supply ports is positioned on the bed surface. The sorting bed arranged with an inclination, the inclination ("α") between the longitudinal extending of the bed surface and horizontal plane is from −2° to +4° and the inclination ("β") between the lateral extending of the bed surface and horizontal plane is from 0° to +15°.

For the longitudinal angle of the bed surface, the positive angle refers to the obliquity formed by the waste-rock discharging end below the horizontal plane and the negative angle refers to the obliquity formed by the waste-rock discharging end above the horizontal plane. For the inclination between lateral bed surface and horizontal plane, the positive angle refers to the obliquity formed by the material discharging side below horizontal plane.

In order to make the materials sorted time after time and make the high-density materials move towards the waste-rock discharging end to improve the sorting accuracy, strip lattice bars are provided on the bed surface at intervals and in parallel. The lattice bars extend from the material discharging side, toward the direction of the backboard and waste-rock discharging end to a position where there is some space apart from backboard, the space constitute the waste-rock channel accordingly. According to experiments, the angle formed by the lattice bars and the feeding side is from 25° to 45°, preferably from 32° to 37°, which leads to best sorting accuracy.

When sorting, the backboard should be provided with a rational obliquity. In this way, the materials to be sorted can be made by the mechanical vibration to do rational spiral rolling motion to improve the sorting accuracy and efficiency accordingly. The angle between the backboard and the bed surface is from 30° to 90°, preferably from 45° to 60°.

The shape of the bed surface is a right angle trapezoid, with the material discharging side being oblique and the bed surface becomes narrower and narrower from the feeding side to waste-rock discharging end. In this way, the materials layer on the bed surface from the feeding side to the waste-rock discharging end will have a uniform thickness.

The ratio of length of the feeding side to the longitudinal length of the bed surface is from 50% to 80%, preferably from 60% to 70%. The width of the bed surface should be chosen rationally in order to let the materials have reasonable sorting time each time they are sorted and improve the sorting accuracy. Rationally choosing the longitudinal length of the bed surface can improve the sorting efficiency and avoid waste.

The height of the discharging baffle is higher than ½ of the maximum grain size of the maximum density of sorted material to prevent the high-density materials from sliding in the light-density materials during the vibration of the sorting bed.

The waste-rock discharging end is provided with a waste-rock gate, which is a gate of board and can be opened and closed. The function of the gate is that when the waste-rock content in the raw coal is low, partially closing the waster rock gate can form a thicker waste-rock layer on the bed surface and prevent the coal grains from dropping in the waste-rock products.

The present invention also provided a combined dry sorting device, comprising frame, sorting bed, vibrator and air supply device. The sorting bed and vibrator are hung in the frame, the vibrator is connected with the sorting bed and the air supply device is connected with the bottom of the sorting bed. The sorting bed comprises a right angle trapezoidal bed surface and the hypotenuse of the right angle trapezoid is the material discharging side of the sorting bed. The material discharging side is provided with a discharging baffle, and the right angle side opposite to the discharging side is provided with a backboard to guide the materials to roll upwards. The wider side of the bed surface is the feeding side and the narrower side is the waste-rock discharging end. A plurality of air supply ports is positioned on the bed surface, and the sorting bed is placed slantwise, the inclination "α" between the longitudinal plane and horizontal plane of the bed surface is from −2° to +4°, and the inclination "β" between the lateral plane and horizontal plane is from 0° to 15°.

Strip lattice bars are provided on the bed surface at intervals and in parallel. The inclination between the lattice bars and feeding side is from 25° to 45°, preferably from 32° to 37°. The inclination between the backboard and bed surface is from 30° to 90°, preferably from 45° to 60°. The ratio of the length of the feeding side of the bed surface to the longitudinal length is from 50% to 80%, preferably from 60% to 70%.

The air supply device comprises the air chambers located under and connected with the sorting bed. The blower fan is connected with the air chambers through the airline and the joints between the airline and air chambers are flexible. There are more than one air chambers and each one is provided with a valve to control the air quantity of each air chamber respectively.

The sorting bed and vibrator are hung in the frame by overhanging device. The overhanging device comprises a steel cable, one end of the steel cable is connected to the top of the frame and the other end is connected to the adjuster in the frame by passing through the traveling block disposed on the sorting bed and the crown block in the frame. The upper end of the steel cable is provided with damping springs.

The vibrator is connected with the backboard of the sorting bed and the vibration passes through the center of gravity of the sorting bed and forms a 20° inclination with the bed surface along the across (lateral) direction of the bed surface.

The present invention further provides an apparatus for separation, which comprises a feeding device, an air supply and dedusting device and a separating device, in which:

(a) feeding device comprises belt conveyer, surge bin and vibrating feeder;

(b) separating device comprises frame, sorting bed, vibrator and discharging device;

(c) air supply and dedusting device comprises air chambers, blower fan, airline, dedusting fan, dust hood, cyclone dust collector and bag type collector.

The belt conveyer is located at the upper part of the surge bin and the bottom of the surge bin is connected with the vibrating feeder.

The sorting bed and vibrator are hung in the frame by the overhanging device. The vibrator is connected with the sorting bed and the material discharging device is under the material-discharging end of the sorting bed.

The outlet of the blower fan is connected with the air chambers at the bottom of the sorting bed. The dust hood is located at the top of the sorting bed and one of the outlets at the top of the dust hood is connected with the cyclone dust collector and is connected with the inlet of the blower fan through the airline. The inlet of the bag type collector is connected with another outlet of the dust hood and the outlet at the top of the bag type collector is connected with the inlet of the dedusting blower fan.

The sorting bed comprises bed surface, backboard and discharging baffle. The bed surface is approximately right angle trapezoid, whose hypotenuse is the material discharging side of the sorting bed. The discharging baffle is located at the material discharging side of the bed surface and the right angle side opposite to the material discharging side is provided with a backboard to guide the materials to roll upwards. The wider base side of the bed surface is the material discharging side and narrower base side is the waste-rock discharging side. The waste-rock gate is located at the waste-rock discharging side of the bed surface. The bed surface of the sorting bed is provided with lattice bars at intervals and in parallel. A plurality of air supply ports is set on the bed surface. The sorting bed is placed slantwise and the inclination "α" between the altitude direction of the trapezoid (longitudinal) and the horizontal plane is from −2° to +4° and the inclination "β" between the direction vertical to the altitude of the trapezoid (lateral) and the horizontal plane is from 0° to 15°.

The material-discharging device comprises discharging sluices of float coal; middling coal and waste-rock and is located under the separating device. An adjustable platform trap door is positioned in the discharging sluice of the material discharging device. The adjustable platform trap is a transversely laid gate shape plane table and its width is a little less than the width of the material-receiving trough. It is installed in the middling and waste-rock receiving trough and its bottom end is at the center of the material discharging port. A handle is provided outside the material-receiving trough. Turning the handle can change the position of the platform trap door to adjust the material receiving width and control the product quality. A belt conveyer is set at the bottom of each material-discharging sluice.

The air chamber is integrated with the bed surface under the bed surface. Each air chamber is flexibly connected with air supply line and a valve is provided at the inlet of every air chamber respectively.

The outlet of the dedusting blower fan is connected with the air exhaust pipe.

Figure 1:
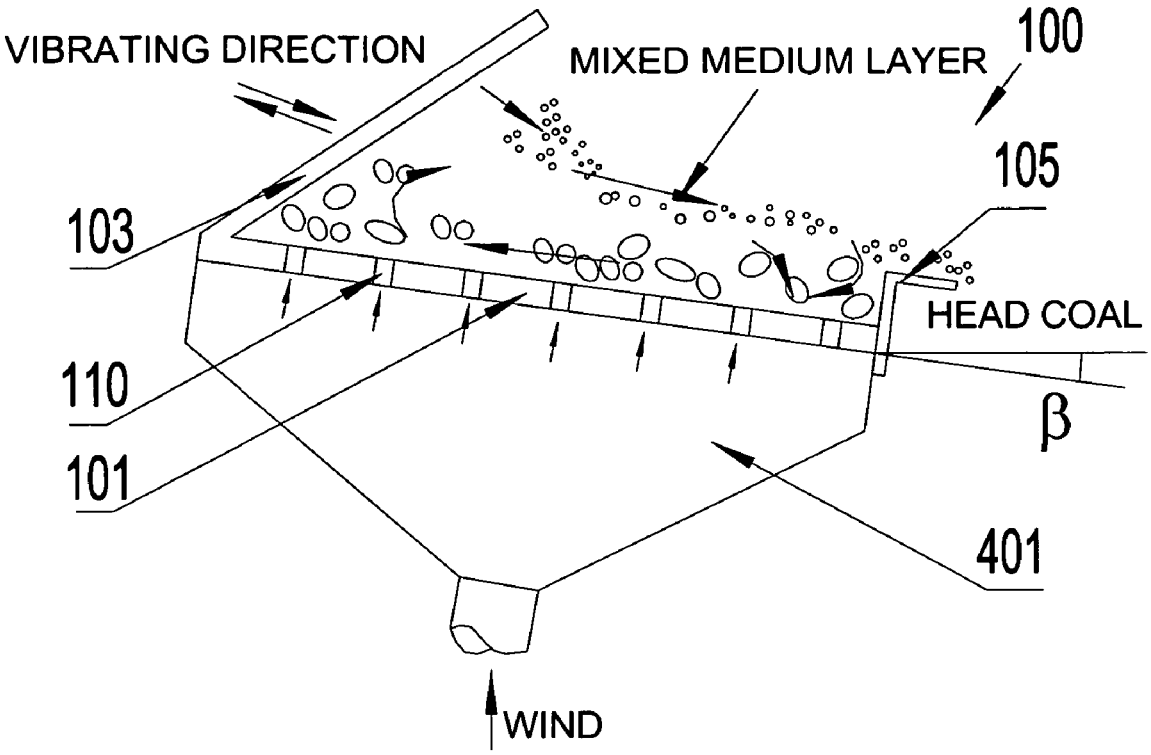
FIG. 1 is a schematic drawing of the side view of the combined dry sorting bed of the present invention.

In which, Sorting bed 100, Bed surface 101, Waste-rock discharging end 102, Backboard 103, Feeding port 113, Discharging side 104, Discharging baffle 105, Feeding side 106, Waste-rock channel 107, Waster rock door 108, Lattice bar 109, Air supply port 110, Wearable rubber bed surface 111, Frame 200, Vibrator 300, Electric motor base 301, Thrust sheet 302, Air supply device 400, Air chamber 401, Blower fan 402, Air-supply line 403, Rubber tube 404, Air door 405, Slag tripper 406, Flange 407, General air door of blower fan 408, overhang device 500, Steel cable 501, Traveling block 502, Fixed block 503, Adjuster 506, Damping spring 507, Material discharging device 600, Material receiving trough 601, Belt conveyer 602, Adjustable platform trap door 603, Waster rock exit 604, Middling exit 605, Float coal exit 606, Dust hood 702, Exit 702, Cyclone dust collector 703, Bag-type dust collector 704, Air duct 705, Dust blower fan 706, Pastern-shaded sealing 707, Exhaust duct 708, Back blower fan 709, Belt conveyer 11, Surge bin 12, Vibrating feeder 13.

DETAILED DESCRIPTION

The foregoing and other objects, features and advantage of the invention will become apparent from the following description of preferred embodiments with reference to the accompanying drawings.

Example 1

Figure 2:
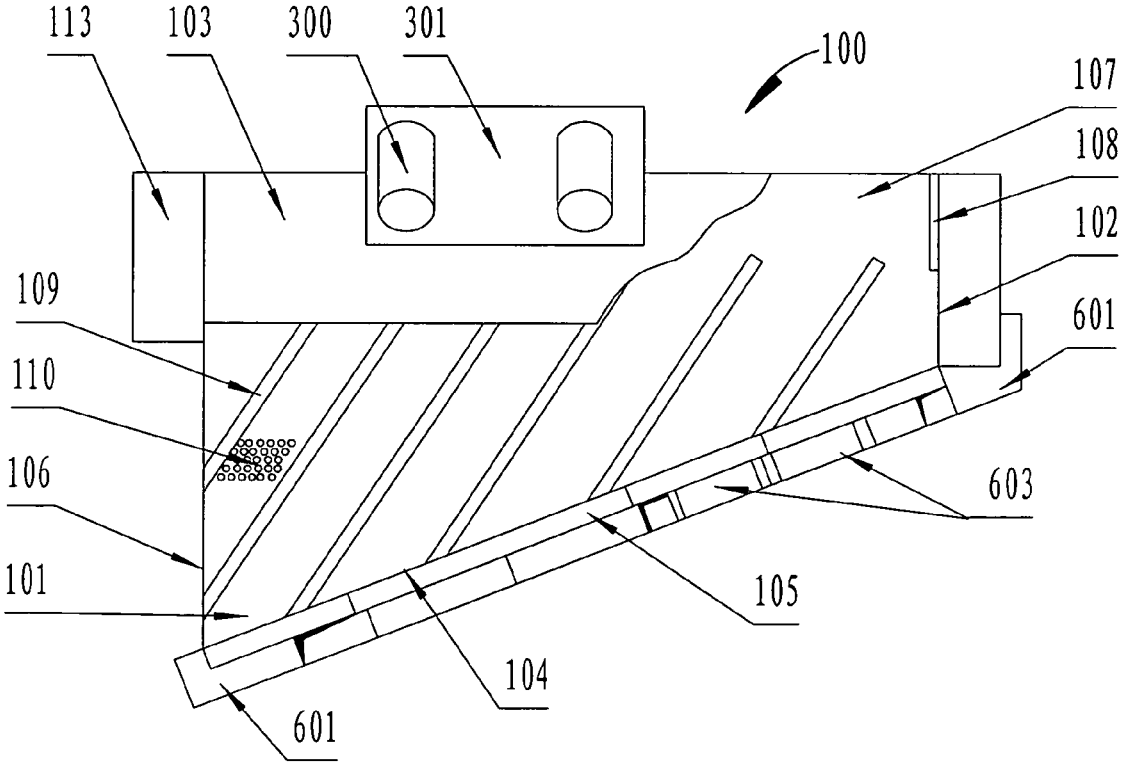
FIG. 2 is a schematic drawing of the top view of the combined dry sorting bed of the present invention.

Referring to FIGS. 1 and 2, which shows the combined dry sorting bed 100 with bed surface 101. The bed surface 101 is in a shape of a trapezoid, and the ratio of the feeding side length to the length of the bed surface 101 is 60%. The material discharging side 104 is the bevel edge of the trapezoid. There is a discharging baffle 105 on the material discharging side 104 and it is set at several places and the height may be adjusted up and down. The lower base line of the right-angled trapezoid is the feeding side 106, the upper base line of the trapezoid is waste-rock discharging end 102, and the backboard 103 leading the material to roll upward is located on the right-angle edge. The height direction of the said trapezoid is defined as the longitude direction of bed surface 101, and the direction normal to the height is the across (lateral) direction. On the bed surface, lattice bar 109 is set at intervals and in parallel. There are some air supply ports 110 on bed surface 101, and the sorting bed is laid slantwise. The angle "α" formed between longitude direction of the bed surface and the horizontal plane is 0°, and the angle "β" form by the across direction of bed surface and the horizontal plane is 10° (not shown in the drawing).

In this embodiment, the ratio of the feeding side to the lengthwise strength of the said bed surface 101 is 60%, so that bed surface 101 may be provided with adequate length and width and the time for each sorting and times of sorting may be more reasonable so as to improve sorting accuracy and efficiency.

In order to improve sorting accuracy and increase sorting times, lattice bars 109 are set on the bed plate at intervals and in parallel, which extends from material discharging side 104 to the direction of backboard 103 and the waste-rock discharging end 102 and to a position where there is some space apart from backboard 103. Therefore, this space forms a waste-rock channel 107, and an inclination of 32° is formed between the lattice bar 109 and the material discharging side 106. The heights of the lattice bars between the feeding port and waste-rock discharging end are respectively 120 mm, 100 mm, 80 mm, and 60 mm, and the others are all 40 mm. The thickness of bed layer at the feeding port is more than 200 mm, and the higher lattice bars prevent large waste-rocks from being mixed into the coal, so that they are separated as early as possible. The descending of the lattice bar height may cause the medium or small blocks of waste-rock to separate, and the height of the lattice bars behind the material discharging side is all 40 mm, which does not affect the rolling of the material to be sorted. When sorting massive raw coal with 40% waste-rock content, if there are no high lattice bars the content of waste-rock in the float coal is 7%, and while there are high lattice bars, the content of waste-rock is 1%, and without any massive waste-rock.

As the inclination between backboard 103 and bed surface 101 is 45°, under the resistance of backboard 103 and the force of vibration, the bulk material is provided with a reasonable helical angle, which is advantageous to separation of the light materials.

In the meantime, the air supply port 110 on bed surface 101 had better be tapering so as to avoid any blockage, and wearable rubber bed surface 111 (not shown in the figure) should be covered on bed surface 101 so as to extend the life of use for the bed surface.

In order to prevent the mineral grains of high density near the material discharging side from dropping into the light materials during the vibration of the bed surface, which is slanting downward, the said discharging baffle 105 is arranged in several sections, whose height can be adjusted. Properly adjusted, the baffle has these functions: to peel off the material of lower density on the surface, to control the thickness of the material layer on the bed surface, and to prevent single waste-rock from entering into the cleaned coal. In this Example, the height of the discharging baffle is about ¾ (at least ½) the largest grain diameter of the waste-rock to be sorted.

At the waste-rock discharging end of sorting bed, there is a waste-rock door 108. In the case that there are only a few waste-rocks in raw coal, partially shut the waste-rock door 108, then a thicker layer of waste-rock on the bed surface may be formed at waste-rock discharging end, so that coal grains are kept away from entering into the waste-rock products.

In practice, the vibrating direction of this sorting bed is at an inclination of 20° between the across direction and the bed surface. The slanting angle of the bed surface of this sorting bed is arranged as downward slanting along the across direction of the bed surface, and as approximately horizontal along the longitude direction in which the material moves. Under the vibration of the bed surface and the wind power below the bed surface, the material executes a helical motion laterally along the bed surface. And under the action of gravity, the materials of lower density on the surface slide down along the material-discharging side 104 and are peeled off by the discharging baffle. Furthermore, longitudinally the bed surface is approximately horizontal, which ensures not only that the materials of high density that passes from feeding side 106 through waste-rock channel 107 to the waste-rock end 102 have certain speed, but also that the materials of lower density are prevented from entering into waste-rock product. According to the content of waste-rock in raw coal, the longitude inclination may be adjusted. When the content of waste-rock in raw coal is the largest (such as more than 20%), in order to adjust the moving speed of waste-rock, the longitude inclination of the bed surface should be adjusted to a positive one, so that the waste-rock may slide down under the vibrating inertia force and gravity. However, the strip of waste-rock should be ensured with an adequate length to reach a dynamic equilibrium. When the content of waste rock in raw coal is small (such as less than 10%), in order to avoid any coal in waste-rock product, the longitude inclination of the bed surface should be adjusted to a negative one, so that the waste-rocks have to climb and their moving speed may be reduced. Partially shut the waste-rock door when necessary so as to ensure the length of the waste-rock. The way to adjust the longitude inclination of the bed surface is the same as that to adjust its lateral obliquity. Modifying the length of the 2 wire ropes near the waste-rock end can change the longitude inclination of the bed surface.

Compared with wind power coal preparation technology in the prior art, this invention has the following advantages:

The sorting bed of the present invention is set in a reasonable obliquity, under the vibration force of bed surface and the action of the wind power, the sorted material vibrates at an inclination of 20° between across direction and bed surface, so that the material is affected by the upward vertical component force and the horizontal component backboard force. When the material move in the backboard direction under horizontal component force, upward wind power and upward component force, the light material is thrown upward; and guided by the backboard, the materials begin to move and roll helically in across direction along the bed surface. As the obliquity between the bed surface and the across direction is 10° downward, it is easy for the light material to be peeled off under the action of gravity. And then the material is discharged along the material discharging side, which is slanting downward. Furthermore, the longitude direction of the bed surface is approximately horizontal; on the one hand, the materials of lower density that pass from the feeding side through waste-rock channel to waste-rock end may be provided with certain speed, on the other hand the materials lighter than waste rocks may be prevented from entering into waste-rock product.

In this Example, by reasonably designing the aspect ratio of the bed surface and increasing the length of the feeding side, the initial sorting time of raw coals is ensured and the sorting accuracy is improved, and as the width from feeding side to waste-rock discharging end is getting narrower and narrower, an even thickness of the material on bed surface is also ensured. Because the feeding side of this invention is wider than that of the existing sorting bed, the time of each sorting is longer, which ensures an adequate sorting time and sorting accuracy. Along with the constant discharging of the sorted light materials, the retained material on the bed surface is getting fewer and fewer. The width of the bed surface is narrowed down, so the material layer on bed surface may keep a certain thickness, so as to improve the sorting accuracy and sort products of various densities from low to high.

The height and obliquity of lattice bars should be chosen reasonably. The bars should be kept parallel and form an inclination of 32° with the feeding side. As the vibrating direction is normal to the direction of backboard, the lower layer of waste-rock close to the bed surface needs a vertical component force, which is caused by the obliquity of the lattice bar, to lead the waste-rock to move toward the waste-rock end. A large obliquity will also cause a large vertical component force, improve the vertical moving speed, and increase the separating speed, so that the treating ability of the sorter is correspondingly improved. Whereas, if the obliquity is too large, the vibrating inertia force will get too large a resistance from the lattice bar, and the effect of the vertical component force will be reduced instead. Therefore, an appropriate obliquity of the lattice bar is needed, so that the material may move to the backboard direction along the lattice bar. The light material is thrown up and rolls upward. The lattice bar leads the materials of high density to move to the waste-rock end, those of lower density are sorted for several times when they roll through the lattice bars because of gravity. Furthermore, the flute between the lattice bars forms a waste-rock layer on the bed surface and that is advantageous to sorting.

In this embodiment, the obliquity of the backboard has been chosen reasonably, and the inclination between the backboard and the bed surface of the sorting bed is 45°, which makes the light material, which is rolling upward along the backboard and being led and driven by the backboard, is thrown up to the material discharging side. There is an electric motor frame and an electric motor outside the backboard. The inner side of the backboard leads the material on the bed surface to roll upward and form a kind of helical motion.

The wearable rubber bed surface has a certain friction coefficient that helps to improve the conveying speed of the material at the bottom layer on the bed surface, and keeps the bed surface from wear and tear. The back-tapering air supply port may avoid any blockage, and the diameter and space between two air supply ports not only ensure an incompact layer on bed surface but also keep the fine coal grain on the bed surface from dropping.

There are several adjustable discharging baffles on the material discharging side of the bed surface. The excellence is that the thickness of the layer may be controlled by adjusting the height of the baffle, and massive waste-rock may also be prevented form entering into cleaned coal. And after adjusting the height of the baffle, the sorted product may be distributed evenly along the material discharging side.

There is a waste-rock door at the waste-rock discharging end on the bed surface. In the case that there are only a few waste-rocks in raw coal, partially shut the waste-rock door, then a thicker layer of waste-rock on the bed surface may be formed at waste-rock discharging end, so that coal grains are kept away from entering into the waste-rock product.

Example 2

It is different from Example 1 in the obliquity of bed surface 101: the angle between longitude direction of the bed surface 101 and the horizontal plane is −2°, and that between the across direction and the horizontal plane is 7°. The proportion of the feeding side to the longitude length of bed surface is 50%. The inclination between the lattice bar and the feeding side is 40°, and that between the backboard and the bed surface is 60°. This Example is applicable for treating mixed coals, where the content of waste-rock is more than 40%. When it is sorted, it is advantageous for the waste-rock to be discharged.

Example 3

The difference between this Example and Example 2 is in the obliquity of bed surface 101: the inclination between the longitude direction of the bed surface 101 and the horizontal plane is +2°, and that between the across direction and the horizontal plane is 11°. The proportion of feeding side to the longitude length of the bed surface is 70%. The inclination between the lattice bar and the feeding side is 30°, and that between the backboard and the bed surface is 45°. This Example is applicable for treating mixed coals, where the content of waste-rock is less than 10%. When it is sorted, it is advantageous for improving the sorting accuracy and treating ability of cleaned coals.

Example 4

The difference between this Example and Example 3 is in the obliquity of bed surface 101: the inclination between the longitude direction of the bed surface 101 and the horizontal plane is +4°, and that between the across direction and the horizontal plane is 13°. The proportion of feeding side to the longitude length of the bed surface is 80%. The inclination between the lattice bar and the feeding side is 45°, and that between the backboard and the bed surface is 70°.

Example 5

The difference between this Example and Example 4 is in the obliquity of bed surface 101: the inclination between the longitude direction of the bed surface 101 and the horizontal plane is +0°, and that between the across direction and the horizontal plane is 3°. The proportion of feeding side and the longitude length of the bed surface is 65%. The inclination between the lattice bar and the feeding side is 25°, and that between the backboard and the bed surface is 30°. This Example is applicable for treating raw coals of small grains, where the content of waste-rock is less than 5%.

Example 6

Figure 3:
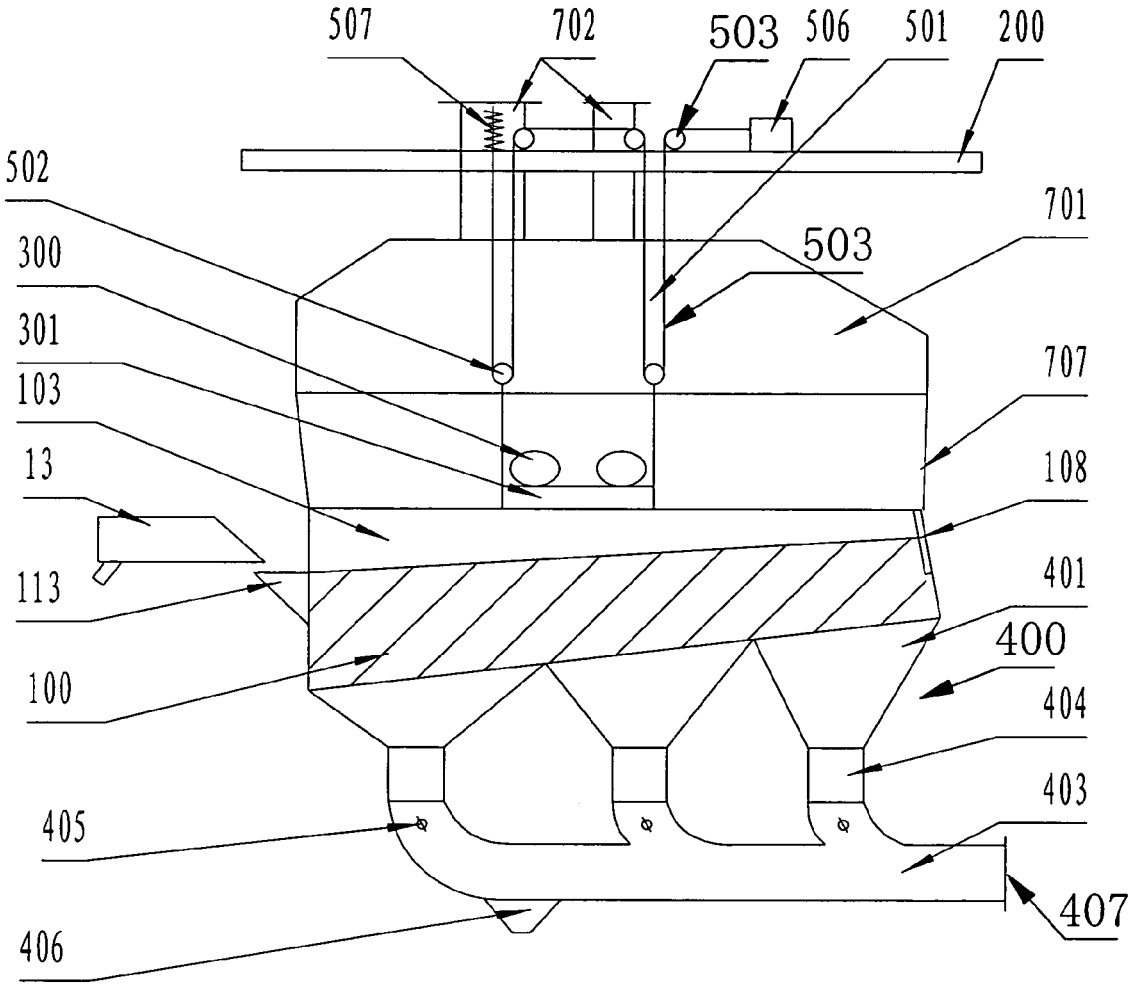
FIG. 3 is a schematic drawing of the front view of the combined dry sorting device of the present invention.
Figure 4:
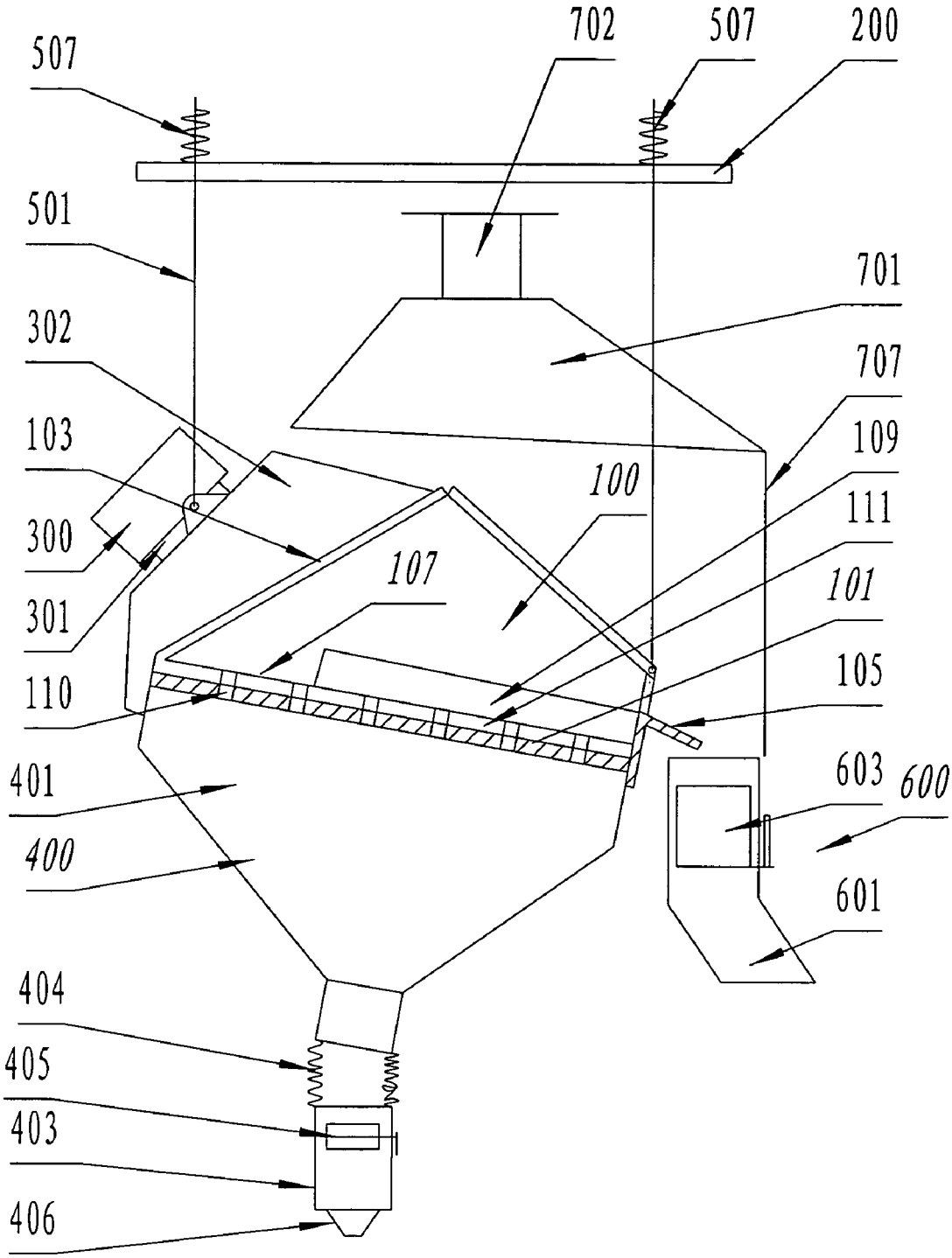
FIG. 4 is a schematic drawing of the side view of the combined dry sorting device of the present invention.

Referring to FIGS. 3 and 4, which show the combined dry sorting device, including sorting bed surface 100, frame 200, vibrator 300, air supplying device 400. The sorting bed 100 and vibrator 300 are both hung on frame 200. Vibrator 300 is connected with sorting bed 100, under which there is air-supplying device 400. The sorting bed 100 is just that described in FIG. 1-2. See the description of the three Examples of sorting bed.

The sorting bed 100 and vibrator 300 are both hung on frame 200 by overhang device 500, for which the steel cable 501 is connected with the top of frame 200 at one end and with the adjuster 506 on the frame 200 at the other end that passing by the traveling block 502 on the sorting bed and by the fixed block 503 on the frame 200. And there is a damping spring 507 on the upper end of eth wire rope 501. By using the electrical adjuster 506 on the overhang device 500, the length of the steel cable 501 may be adjusted to change the transversal or longitudinal inclination of the bed surface 101. The sorting bed is installed on the frame with a hanging structure, so vibration resistance and energy dissipation are small. The base vibration is very weak because of the damping spring. Due to the combined use of the fixed block and the traveling block, the stress of the wire rope is reduced. The transversal or longitudinal inclination of the bed surface may be adjusted through the electrical adjuster.

The shape of the bed surface 101 of the sorting bed 100 is about a right-angled trapezoid, of which the inclination "α" between the longitude direction and the horizontal plane is 4°, and the inclination "β" between the cross direction and the horizontal plane is 12°. The discharging baffle 105 is on the discharging bevel edge of the right-angled trapezoid, and the feeding port 113 is on the feeding edge on the lower base line of the right-angled trapezoid. Backboard 103 that leads the material to roll upward is on the right angle edge opposite the material discharging side 104, and a waste-rock door 107 is set at the waste-rock discharging end on the upper base line of the trapezoid. Further more, there paved a rubber bed surface 111 over the bed surface 101, on which there have been set a number of lattice bars 109 that extends from material discharging side 104 to the direction of backboard 103 and the waste-rock discharging end 102 to a position where there is some space from backboard 103. Therefore, this space forms a waste-rock channel 107, and an inclination of 35° is also formed between the lattice bar 109 and the material discharging side 106. Some ports 110 are set between the lattice bars on the bed surface. Below one side of the material discharging side of the bed surface 101 is material discharging equipment 600, including material receiving trough 601, which is below the discharging baffle 105. Inside the material-receiving trough there is an adjustable platform trap door 603 that may be adjusted transversely. A belt conveyer (now shown in the figure) can be set below the material-receiving trough 601, which conveys the sorted products to designated places. By one side of the material discharge edge of the bed surface, there are several material receiving troughs with adjustable platform trap doors. The quality of the discharged products may be controlled by adjusting the platform trap door to change the width of the received materials.

The air supply device 400 comprises an air chamber 401 below and integrated with the sorting bed 100. The air chamber 401 is connected with the blower fan (not shown in the figure) through the air-supply line 403. Air chambers 401 are respectively connected with air-supply line 403. At the lower end of the air-supply line 403 there is a slag tripper 406, and the other end of the air-supply line 403 is connected with the blower fan (not shown in the figure) via a flange 407. Being integrated with the sorting bed, the air chamber is able to vibrate together with the sorting bed. There may be several air chambers, and for this Example, there are 3 air chambers, which are respectively provided with an air door 405 controlling the air delivery of every air chamber. The slag tripper 406 may eliminate the float coal granules leaking into the air duct from the bed surface.

Vibrator 300 is a double-vibration rectilinear electric vibrator that is integrated with backboard 103 of the sorting bed 100 through electric motor frame 301 and thrust sheet 302. Its vibrating direction is through the center of gravity of the sorting bed and in the across direction of bed surface 101, with which a inclination 20° is formed. Adjusting the excitation force of the electric vibrating motor, the swing of the sorting bed 100 may be changed. As the inclination between the vibrating direction and the bed surface is 20°, not only are the materials in the bottom provided with an adequate motion velocity, but the motion of the materials will not damage the waste-rock layer.

Over the sorting bed 100, there is a dust hood 701 and two coordinate exits 702, which are respectively connected with the dedusting device (not shown in the figure) to discharge purified air into the atmosphere. Around the dust hood 701 and to the sorting bed 100, there is pastern-shaded sealing equipment 707 to prevent outflow of the coal dust from the sorting bed.

When being sorted, the materials are sent into the feeding port 113 from the feeding machine 13 above the sorting bed 100 and then form a material layer on the bed surface. Air is sent into the air chamber 401 in the bottom of the bed surface, and an upward airflow will then form through the airports 110 on the bed surface. By the combined action of the vibrating force and the upward airflow, the material layer on the bed surface will get incompact and the mineral grain will be delaminated as per density. As the inclination between the vibrating direction and the horizontal plane is 20°, the upward airflow makes the fine grains in the raw coal float and form a mixed medium layer of gas and solid. Therefore, under the vibrating inertial force, the materials contacting with the bed surface move from the discharging baffle 105 to the backboard 103 along the lattice bar 109. Being resisted and guided by backboard 103, the material roll upward and form a material layer of low density on the surface. And with the effect of the gravitation, the materials glide down to the discharging baffle 105, which peels off the float coal of the lowest density and drops them into the material-receiving trough 601. Most of the retained materials will continue to make shuttling movement for sorting. The bottom layer of high-density material on the bed surface moves to the corner of backboard 103 and bed surface 101 and then moves to the waste-rock discharging end through the waste-rock channel 107. Passing through the waste-rock door 108, it is discharged into the waste-rock-receiving trough 601. Being peeled off layer by layer, products of different ash content ranging from low to high are produced, and finally waste-rocks and sulfur iron ores of the highest density are discharged.

The combined dry sorting device has a simple structure and a unique sorting principle. Compared with wind-driven coal sorting technology in the prior art, it is provided with more advantages such as less investment, lower production costs, higher sorting efficiency, less environmental pollution, smaller land occupancy, stronger applicability, shorter construction period, and fewer maintenance times and so on.

Figure 5:
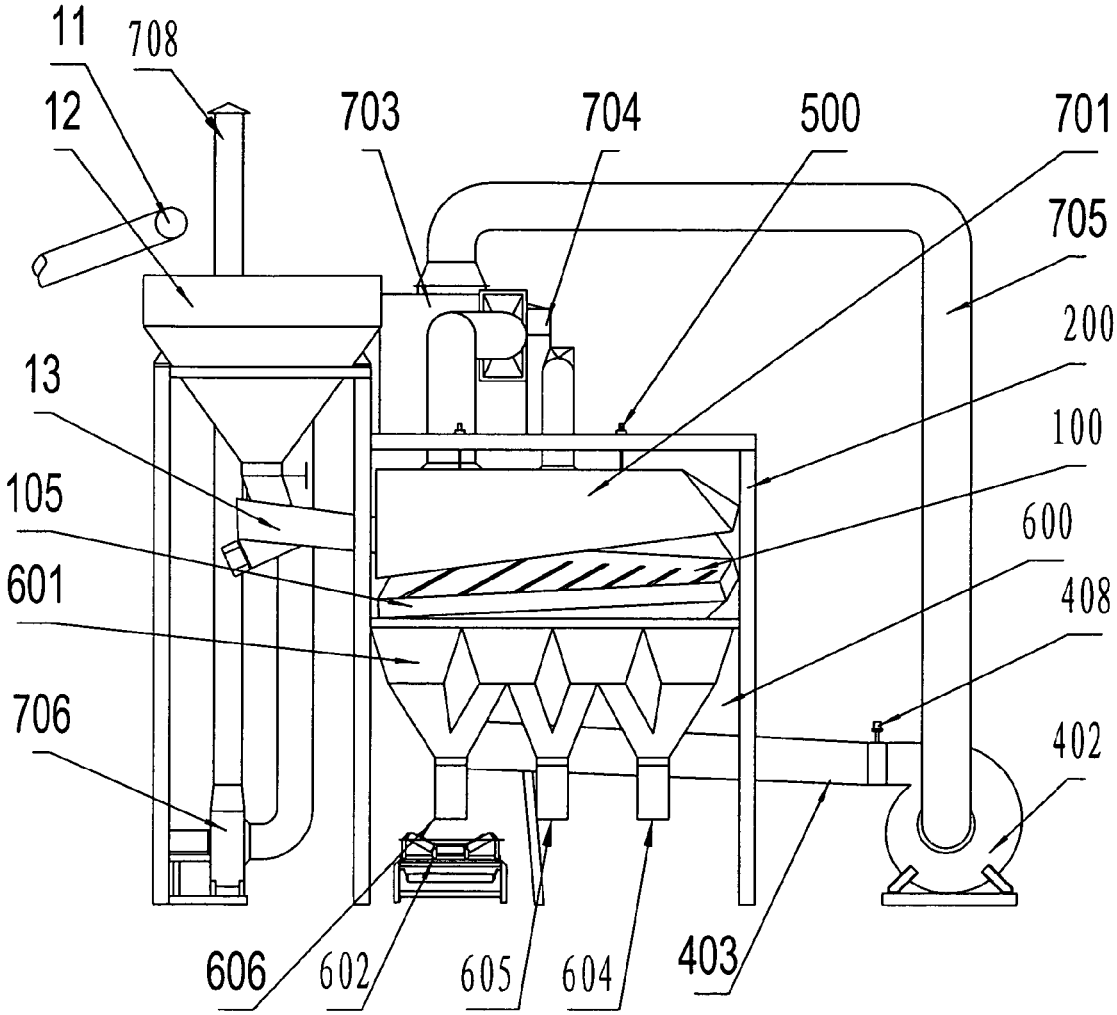
FIG. 5 is a schematic drawing depicting the front view of the apparatus for separation of the present invention.
Figure 6:
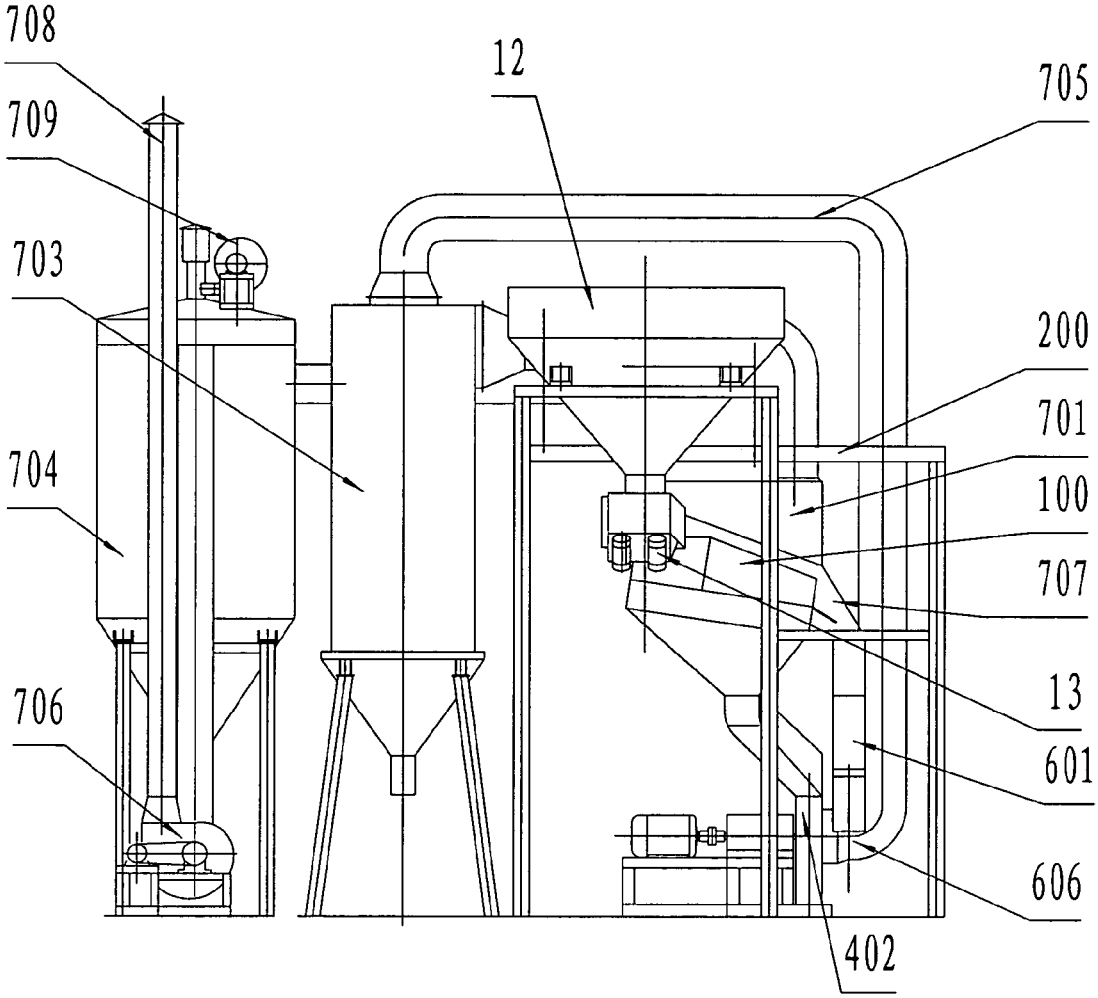
FIG. 6 is a schematic drawing depicting the side view of the apparatus for separation of the present invention.
Figure 7:
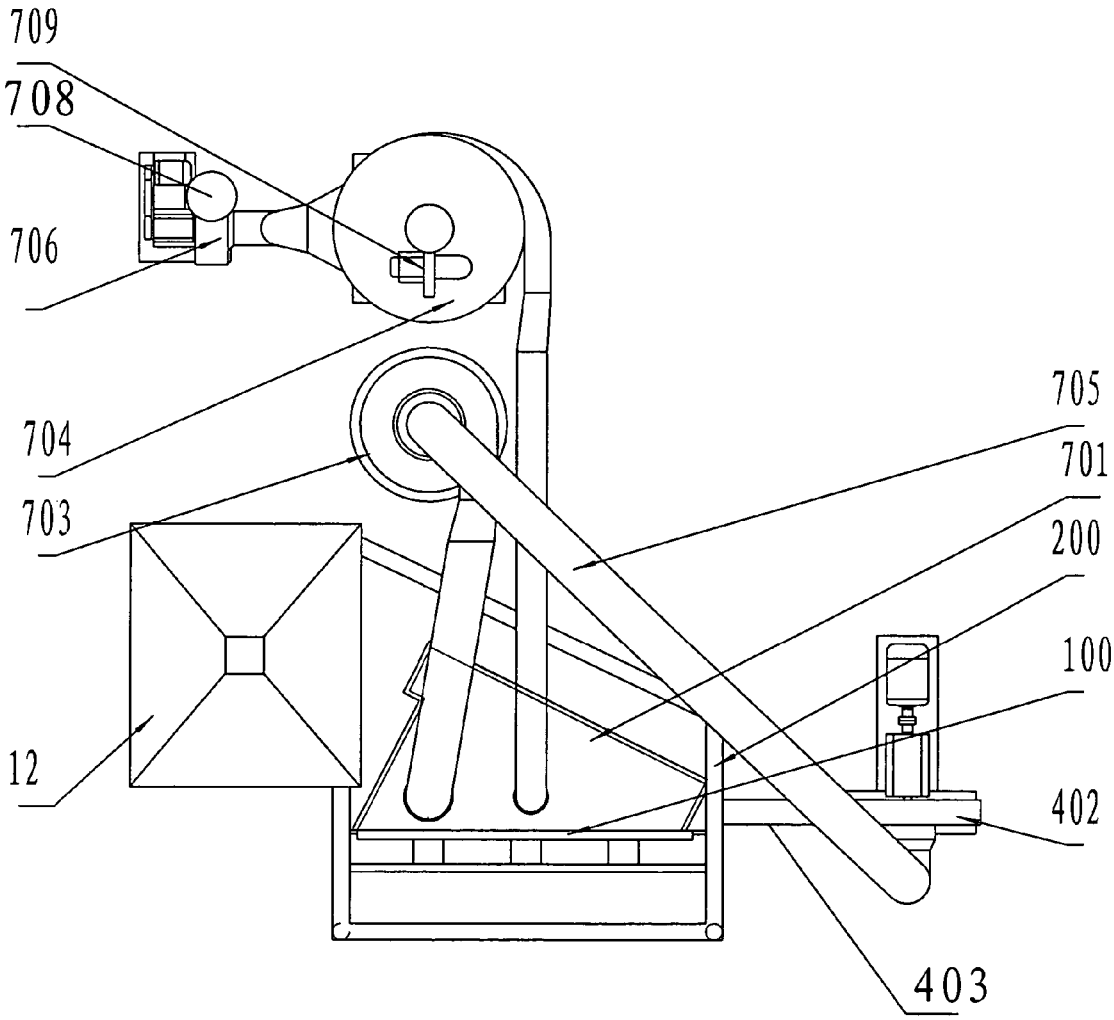
FIG. 7 is a schematic drawing depicting the top view of the apparatus for separation of the present invention.

Referring to FIG. 5-7, which shows an apparatus for the separation of coal that comprises a feeding device, an air supply and dedusting device and a separating device, in which, The feeding device: comprising belt conveyer 11, surge bin 12, and vibrating feeder 13.

The sorting device: comprising frame 200, sorting bed 100, vibrator 300, and material discharging device 600.

The air supplying and dust collecting device: comprises air chamber 401, blower fan 402, air supply line 403, general air door 408, dust blower fan 706, cyclone dust collector 703, and bag-type dust collector 704.

The belt conveyer 11 is located at the top of the surge bin 12, which is connected downward with the vibrating feeder 13. The said sorting bed 100 and vibrator 300 are both installed on frame 200 through an overhang device 500, as shown in FIG. 4. Vibrator 300 is combined by a vibrating motor, which is connected with sorting bed 100 through electric motor base 301 and thrust sheet 302. Material discharging device 600 is located below the material discharging end of sorting bed 100. The exit of blower fan 402 is connected with air chamber 401 in the bottom of sorting bed 100 through air-supply line 403. As shown in FIG. 4, as this sorting bed is the same as the one shown in FIG. 4. The air chamber 401 is connected and integrated with sorting bed 100. The dust hood 701 is located over sorting bed 100 and is connected through an exit on the top with the cyclone dust collector 703, and it is also connected through air duct 705 with the entry of blower fan 402. The other exit of dust hood 701 (or several exits may be set) is connected with the entry of bag-type dust collector 704, of which the exit on the top is connected with the entry of dust blower fan 706. The exit of dust blower fan 706 is connected with exhaust duct 708. On the upside of bag-type dust collector 704 is back blower fan 709, and on air-supply line 403 in front of blower fan 402 is the general electric air door 408.

As shown in FIGS. 1 and 2, sorting bed 100 of this sorting unit includes bed surface 101, which is in the shape of a right-angled trapezoid. On the material discharge edge 104 on the bevel edge of the trapezoid, there are several discharging baffles 105, which are adjustable up and down. The lower edge of the trapezoid is feeding side 106, and the upper edge is waster rock discharging end 102, where there is a waste-rock door 108. Backboard 103 guiding the material to roll up and down is located on the right angle edge of the trapezoid. On the bed surface, there are lattice bars 109 leading the material to move. The height direction of the trapezoid is defined as the longitude direction of bed surface 101, and the direction normal to the height is the across direction. There are some air supply ports 110 on bed surface 101, and the sorting bed is laid slantwise. The inclination "$\alpha$" between the longitude direction of bed surface 101 and the horizontal plane is from −2° to +4°, and the inclination ("$\beta$") between across direction of bed surface and horizontal plane is from 0° to +15°.

As shown in FIG. 3, the air chamber in this embodiment is connected with bed surface downward. Every air chamber 401 is connected with air-supply line 403 through rubber tube 404, and in which there is set an air door 405 respectively.

The material-discharging device 600 comprises material receiving troughs for cleaned coal, middling and waster rock, and is below the sorting bed. In material discharging trough 601 there is an adjustable platform trap door 603, and below the material-discharging trough 601 there is a float coal exit 606, where there is a belt conveyer 602 to transport cleaned coal. Below the material-receiving trough 601 for middling and waste-rock, there is waste-rock exit 604 and middling exit 605.

The operation principle of this embodiment is that the belt conveyer 11 send the raw coal into surge bin 12, the vibrating feeder 13 controls and evenly feeds the material into sorting bed 100; the fed-in raw coal form a material layer of some thickness on sorting bed 100 and get incompact under vibrating force and wind power and then is delaminated as per densities. The float coal of lower density on the top layer of the material passes through the discharging baffle 105 and drop to material-receiving trough 601 then to the float coal exit 606 and finally to the belt conveyer 602 to be transported to outside. The layer of waste-rock and sulfur iron ore in the bottom of the bed surface concentrates at the waste-rock end under vibrating inertia force and is discharged through waste-rock exit 604. There is dust hood 701 on the upper side of sorting bed 100 and there are at least 2 coordinate exits to collect the dust. There are 2 lines for coordinate dust collection: one is that the dusty gas is sent into cyclone dust collector 703 from one exit of dust hood 701, then return back to blower fan 402 after the dust is removed, which then sends into each air chamber 401 through air duct 403 and therefore a shuttling movement is formed. This operating line ensures a good sorting effect and there is less wear and tear for the impeller of the blower fan. The other is that part of the dusty air and the air around the dry-way sorter enter into eth bag-type dust collector 704 from the other exits of dust hood 701, then the filtrated purified air is drained into the atmosphere through exhaust duct 708 by dust blower fan 706 under the bag-type dust collector 704, so that it is operated under negative pressure and ensure that the operational environment and the atmospheric environment will not be polluted. On the top of bag-type dust collector 704, there is installed a back blower fan 709 to clean up the coal dust on the filter bag.

The feeding may be controlled by the way adjusting the swing and the obliquity of vibrating feeder 13, and the longitude direction and across direction degree of the sorting bed 100 may be controlled by the way adjusting overhang device 500, so that the work efficiency and sorting effect may be improved, and the air delivery of every air chamber, the excitation force of vibrator 300, the height of material-discharging baffle 105, the width of waste-rock door 108 may be all adjusted and the degree of adjustable platform trap door 603 in material-receiving trough 601 may also be adjusted, and various raw coals may all be sorted with the best effect.

The present invention may also be provided with electric control parts, including stepping-down starting cabinet, electric power distribution cabinet, and auto-control cabinet, all of which may achieve manual or automatic linked control, automatic control in starting and shutting down, automatic alarm, shutting down resonance protection of the table, and the system running status indication and so on.

The apparatus of the present invention is provided with a simple structure, a wide application range, and a high sorting efficiency. It is easy and convenient to be operated and to be dismantled, transported, and installed. The air supplying and dust collecting part ensures that a smooth sorting operation of the combined dry-type sorting device and apparatus can be obtained, a clean working environment kept, dust contamination prevented and a high efficiency of coal sorting and dust collecting attained.

We claim:

1. A combined dry sorting bed, comprising:

a bed surface that is approximately a right-angled trapezoid, wherein the hypotenuse of said bed surface is a material discharging side and wherein the material discharging side comprises a discharging baffle;

a backboard for guiding material to roll upwards is set at the approximate right angle side of said bed surface opposite to said material discharging side, wherein a feeding side of said bed surface is wider than a waste-rock discharging end of said bed surface; and, a plurality of air supply ports are provided on said bed surface, wherein said bed surface is arranged with an inclination, wherein the inclination between the longitudinal extension of said bed surface and horizontal plane is from −2° to +4° and the inclination between the lateral extension of said bed surface and horizontal plane is from 3° to +15°;

a plurality of strip lattice bars in parallel are positioned at intervals on said bed surface, and said lattice bars extend from the material discharging side, toward the direction of the backboard and waste-rock discharging end to a position where there is a space apart from backboard, the space constituting the waste-rock channel, wherein said bars each have a height, and wherein the heights of said bars descend in turn from said feeding side to said waste-rock discharging end, the heights of the lattice bars between the feeding port and waste-rock discharging end are respectively 120 mm, 100 mm, 80 mm, and 60 mm, and the others are all 40 mm;

wherein the angle between said lattice bars and said feeding side is from 32° to 37°;

wherein the angle between said backboard and said bed surface is from 45° to 60°;

wherein the ratio of length of said feeding side to the longitudinal length of said bed surface is from 60% to 70%;

wherein the height of said discharging baffle is higher than ½ of the maximum grain size of the maximum density of sorted material; and wherein said waste-rock discharging end is provided with a waste-rock gate.

2. The combined dry sorting bed of claim 1 wherein said waste-rock discharging end is provided with a waste-rock gate.

3. A combined dry sorting device containing the sorting bed of claim 1, further comprising:

a frame;

a vibrator;

an air supply device, wherein said sorting bed and said vibrator are hung in the frame, said vibrator is connected to said sorting bed, and said air supply device is connected to the bottom of said sorting bed, wherein said sorting bed comprises a bed surface that is approximately right-angled trapezoid with a material discharging side as the hypotenuse thereof; and, a discharging baffle extending along said material discharging side;

wherein said vibrator is connected to said backboard of said sorting bed and the direction of vibration is along an across direction of the bed surface and passes through a center of gravity of said sorting bed, and forms approximately a 20° inclination with the bed surface; and wherein said sorting bed and vibrator are hung respectively in the frame by an overhanging device, said overhanging device comprising a steel cable, wherein one end of said steel cable is connected to a top of said frame, and wherein the other end is connected to an adjuster in said frame by passing through a traveling block disposed on said sorting bed and a crown block in said frame, and said upper end of the steel cable is provided with damping springs.

4. The device of claim 3 wherein said air supply device comprises air chambers located under and integrally connected with said sorting bed, wherein a blower fan is connected with the air chambers through an air line, and wherein joints between the air line and air chambers are flexible joints.

5. The device of claim 4 further comprising a plurality of air chambers, each having an air valve to control air quantity.

6. The device of claim 3 wherein a plurality of strip lattice bars are positioned in parallel at intervals on said bed surface, wherein said lattice bars extend from said material discharging side toward the direction of the backboard and waste-rock discharging end to a position spaced from the backboard, to form the waste-rock channel, and wherein said bars each have a height, and wherein the heights of said bars descend in turn from said feeding side to said waste-rock discharging end, the heights of the lattice bars between the feeding port and waste-rock discharging end are respectively 120 mm, 100 mm, 80 mm, and 60 mm, and the others are all 40 mm.

7. The device of claim 6 wherein an angle between said lattice bars and said feeding side is from 32° to 37°.

8. The device of claim 3 wherein an angle between said backboard and said bed surface is from 45° to 60°.

9. The device of claim 3 wherein a ratio of length of said feeding side to the longitudinal length of said bed surface is from 60% to 70%.

10. The device of claim 3 wherein said air supply port on said bed surface is in the form of a reverse taper.

11. The device of claim 3 wherein said bed surface is covered with wearable rubber.

12. The device of claim 3 further comprising a material discharging device is located under said material-discharging end of said sorting bed, wherein said material discharging device receives material below the discharging baffle; and, an adjustable trap door.

13. The device of claim 3 wherein a dust hood is further provided over at least a portion of said sorting bed, said dust hood having at least two exits.

* * * * *